United States Patent [19]

Schill

[11] 3,959,619

[45] May 25, 1976

[54] METHOD OF DRAWING-IN OR FLATTENING DENTS IN SHEET METAL

[76] Inventor: Erwin Schill, Poststrasse 196, 8957 Spreitenbach, Switzerland

[22] Filed: Mar. 27, 1974

[21] Appl. No.: 455,322

[52] U.S. Cl. ..... 219/50; 72/705; 219/119; 219/128

[51] Int. Cl.[2] ..... H05B 3/00

[58] Field of Search ..... 72/705; 219/50, 78, 219/70, 86, 98, 119, 128, 149; 228/46

[56] References Cited

UNITED STATES PATENTS

| | | | |
|---|---|---|---|
| 2,227,476 | 1/1941 | Williams et al. | 228/46 |
| 2,272,968 | 2/1942 | Dyer | 219/128 X |
| 2,278,487 | 4/1942 | Rakos | 219/78 X |
| 3,415,970 | 12/1968 | Cline | 219/70 |
| 3,801,772 | 4/1974 | Curcio et al. | 219/98 |
| 3,854,029 | 12/1974 | Fenollar | 219/149 |

*Primary Examiner*—Arthur T. Grimley
*Assistant Examiner*—N. D. Herkamp
*Attorney, Agent, or Firm*—Karl F. Ross; Herbert Dubno

[57] ABSTRACT

One side of a source of electrical energy is connected to a dented metal sheet and a hammer electrode connected to the other side of the source is successively brought into instantaneous contact with a multiplicity of locations spaced apart over the dent. The sheet is electrically heated at the location so that stresses in the sheet are relieved, thereby relaxing the sheet and flattening the dent. The electrode is generally L-shaped and has a pointed copper tip surrounded by a safety sleeve with only the point of the tip projecting from the sleeve.

1 Claim, 7 Drawing Figures

11
8'
8''
VII
15
13
8
a
12
14
9
7
10

METHOD OF DRAWING-IN OR FLATTENING DENTS IN SHEET METAL

FIELD OF THE INVENTION

The present invention refers to a method of and apparatus for flattening a dent in a metal sheet. More specifically this invention concerns an apparatus particularly usable in repairing an automobile body or the like.

BACKGROUND OF THE INVENTION

Dents in sheet metal, as for example in the body of an automobile, are usually flattened by means of a two-stage operation. First the dent is pulled out from its concave side or hammered out from its convex side until it assumes a position slightly below that position which it had before the dent was formed. Thereafter the dented region is filled and this filler is sanded and smoothed out.

This operation is relatively costly, as it demands the careful work of skilled personnel. Furthermore such a process leaves stresses in the metal which make the repaired region readily deformable.

OBJECTS OF THE INVENTION

It therefore is an object of the present invention to provide an improved method of flattening a dent in a metal sheet.

Another object of this invention is the provision of a method which substantially decrease the amount of work necessary to flatten out a sheet-metal dent.

A further object is to provide an improved apparatus which can be used by even relatively unskilled workers to draw in or flatten out a dent in a metal sheet.

SUMMARY OF THE INVENTION

These objects are attained according to the present invention in a method wherein the dented metal sheet is connected to one side or pole of a source of electricity and an electrode connected to the other side is successively brought into instantaneous contact with a plurality of locations spaced apart over the dented region. Thus the electrode is brought against the surface in a series of hammer blow-like movements which heat the metal up in the locations on which the blows fall to a relatively high temperature. This invention is based on the surprising discovery that this localized heating causes the metal to draw in without stresses in the area surrounding the heated location. Apparently the stresses created in the sheet metal when it is dented are relaxed by this localized heating, and tend to draw the sheet metal to its original undented shape.

In accordance with further features of the present invention an apparatus for carrying out the method comprises a portable housing in which is provided a transformer having a choking coil or control resistors. One side of the secondary of the transformer is connected to the sheet-metal workpiece via a clamp, and the other side is connected to the welding electrode which is provided in accordance with this invention with a protective shield in the form of a tube surrounding the electrode. Means is provided to vary the voltage at the secondary of the transformer, thereby limiting the current which is passed by the electrode through the sheet metal workpiece. The amount of electrical energy passing between the electrode and the workpiece is proportional to the amount of heating in the workpiece.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
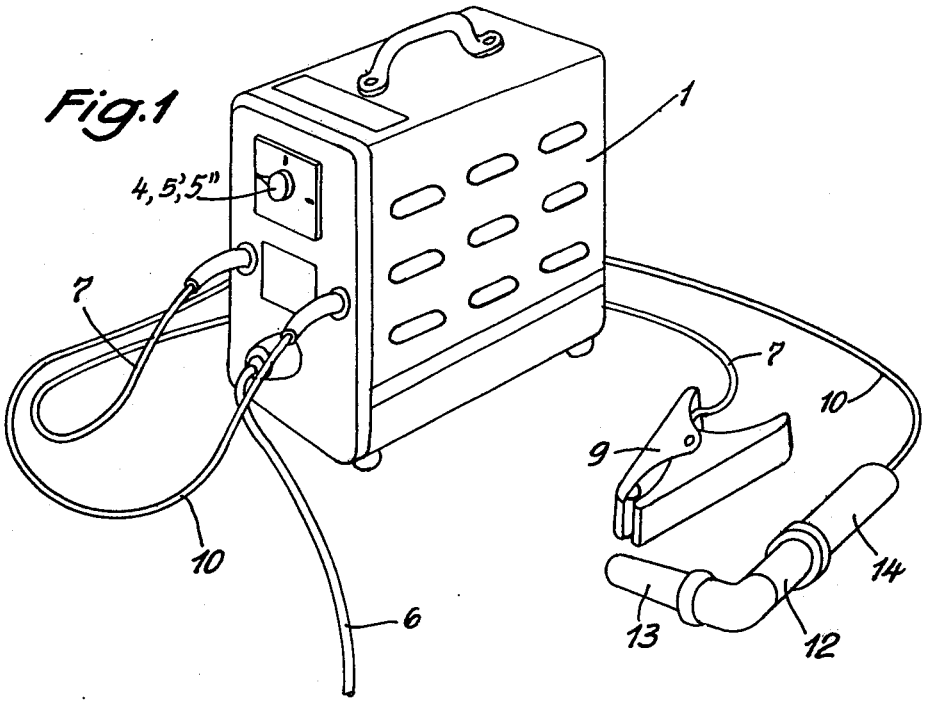
FIG. 1 is a perspective view of the apparatus according to the present invention.
Figure 2:
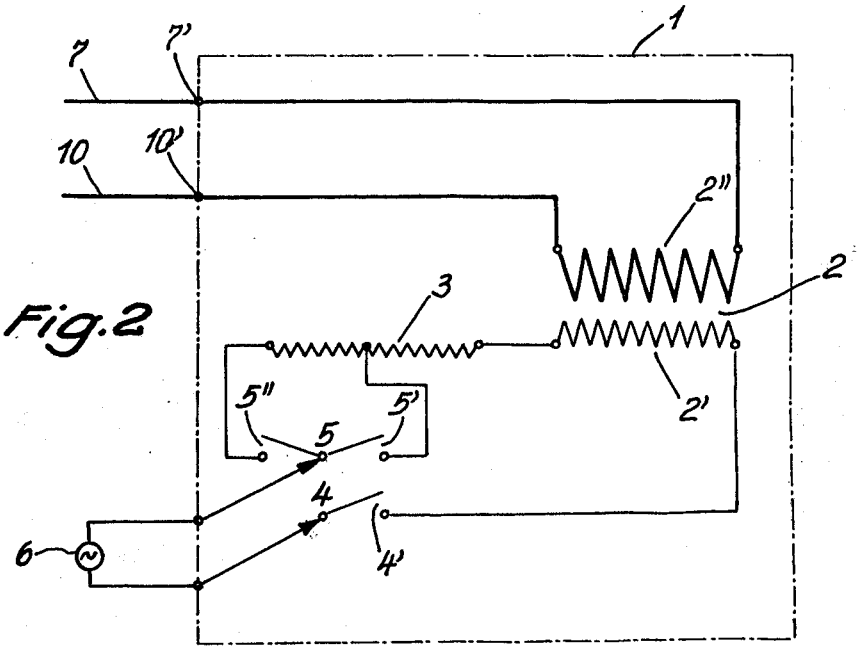
FIG. 2 is a schematic view of the apparatus shown in FIG. 1.
Figures 3, 4, 5, 6, 7:
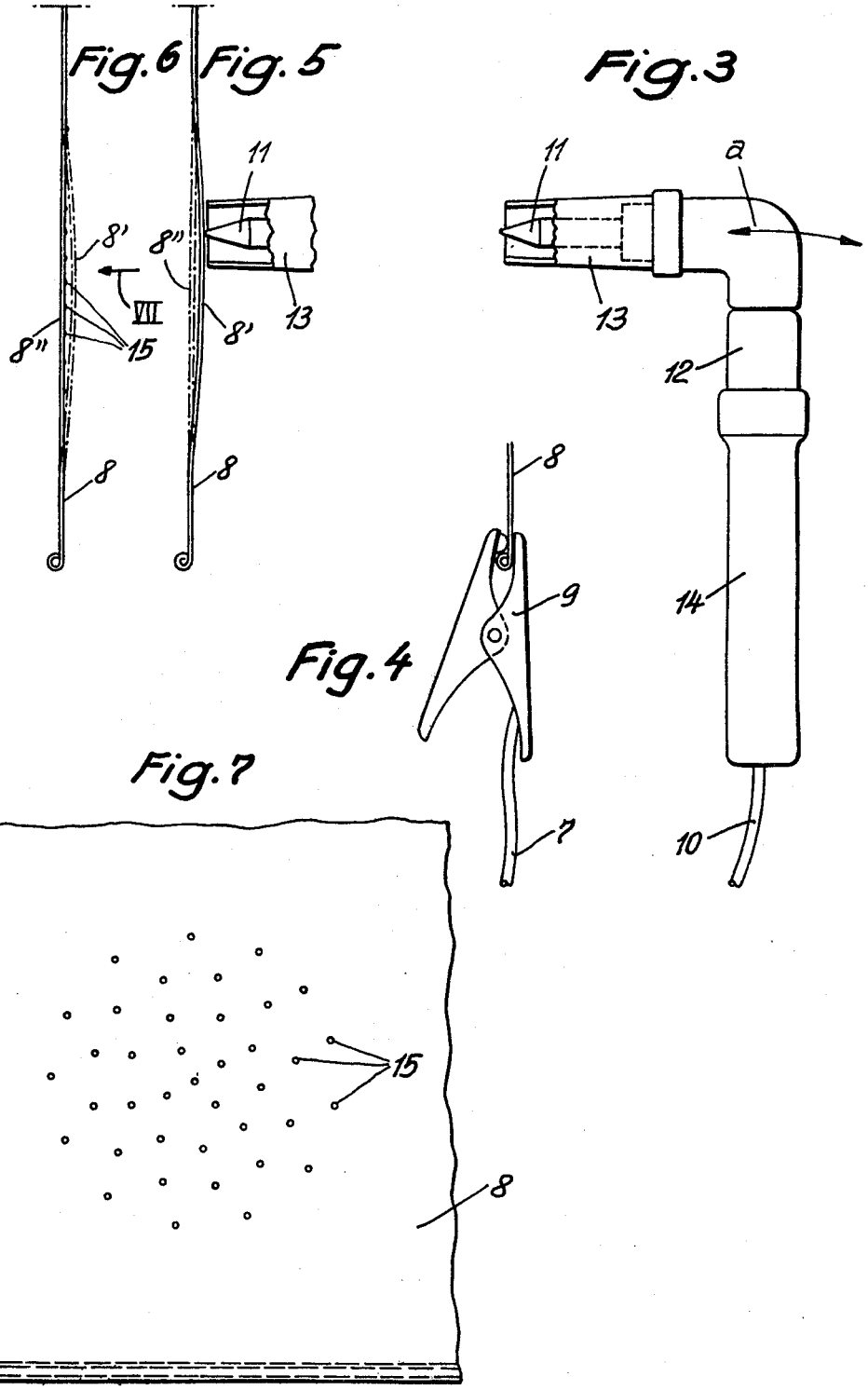
FIGS. 3 and 4 are side views of the two electrodes in accordance with the present invention.
FIGS. 5 and 6 are side views of a workpiece before and after, respectively, treatment according to the present invention.
FIG. 7 is a view taken in the direction of arrow VII of FIG. 6.

The apparatus according to the present invention as shown in FIGS. 1 and 2 comprises a portable housing 1 in which is contained a heavy-duty transformer 2 having a primary winding 2' connected via a center-topped resistor 3 to a switch 5 on one side and on the other side to an ON-OFF/switch 4. The center top of the resistor 3 is connected to one pole 5' of the SPDT switch 5 and the end of the resistor 3 is connected to the other pole 5'' of this switch 5. The other side of the winding 2' is connected to the single pole 4' of the SPDT ON-OFF switch 4. The secondary 2'' transformer 2 is connected to jacks 7' and 10' into which are plugged cables 7 and 10 to which are connected electrodes. FIG. 3 shows a L-shaped hammer electrode 12 having a handle 14 and provided with a copper electrode tip 11 which is surrounded by a tube 13. The electrode tip 11 has a point projecting beyond the end of the protective tube 13.

FIG. 4 shows how the other electrode 9 is in the form of a pincher-type grounding clamp 9 adapted to be clipped to a sheet-metal workpiece 8.

In practice the electrode 12 is oscillated back and forth as shown by double-headed arrows *a* of FIG. 3 into and out of contact hammer-like with the dented region of a workpiece 8 as shown in FIG. 5. Each time the electrode tip 11 strikes the workpiece 8 it forms a small softened location 15 thereon. As the electrode 12 is brought in this manner into contact with the entire region of the dent the stresses in the dent are relaxed to draw the dent from the position shown at 8' to the position shown at 8'' in FIGS. 5 and 6.

Preferably the spots 15 are made on the inside of the workpiece where they will not be visible. If this is impossible, however, the spot 15 can be made on the outside, so that the outer surface of the workpiece 8 will have to be sanded before it is refinished.

I claim:

1. A method of flattening a dent in a metal sheet comprising successively hammering a live copper hammer electrode into instantaneous contact with a multiplicity of locations spaced apart over said dent by striking and impacting the dent with the electrode, passing an electric current through the metal sheet upon impact of the electrode therewith, thereby electrically heating said sheet locally at said locations to relieve stresses in said sheet at said dent, relaxing the sheet and drawing out said dent, and connecting said sheet to a ground electrode prior to bringing said live electrode into contact therewith.

* * * * *